US007186135B2

(12) United States Patent
Maegawa et al.

(10) Patent No.: US 7,186,135 B2
(45) Date of Patent: Mar. 6, 2007

(54) CONNECTOR AND ASSEMBLING METHOD THEREFOR

(75) Inventors: Akihito Maegawa, Yokkaichi (JP); Shinyu Nagashima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/452,747

(22) Filed: Jun. 14, 2006

(65) Prior Publication Data

US 2006/0286855 A1 Dec. 21, 2006

(30) Foreign Application Priority Data

Jun. 17, 2005 (JP) ..... 2005-177700

(51) Int. Cl.
*H01R 3/00* (2006.01)

(52) U.S. Cl. ..... 439/490; 439/680; 439/607

(58) Field of Classification Search ..... 439/489–490, 439/364, 362, 723, 607–610, 545, 567, 157–160, 439/266; 411/8, 13–14
See application file for complete search history.

(56) References Cited

U.S. PATENT DOCUMENTS 5,490,799 A 2/1996 Yamamoto
5,820,405 A * 10/1998 Yagi et al. ..... 439/489
5,836,787 A * 11/1998 Kodama ..... 439/567
6,533,615 B2 * 3/2003 Koide et al. ..... 439/610
6,739,888 B2 * 5/2004 Kato et al. ..... 439/157
2004/0132349 A1 * 7/2004 Sakurai et al. ..... 439/723

FOREIGN PATENT DOCUMENTS

JP 11-54203 2/1999

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

An ECU connector (1) is connectable with a tower connector (2). The two connectors are completely connected by tightening a bolt (4) after being fit to a specified depth and centered with respect to each other. At the specified depth, a detection arm (32) on the ECU connector (1) resiliently engages a receiving portion (12) on the tower connector (2) and a surface facing the detection arm (32) can be hit by the detection arm (32). Accordingly, by starting bolt tightening after the specified depth is reached, problems such as deformations of the leading ends of tower male terminals (13) and damage to the two connectors (1, 2) can be avoided.

6 Claims, 6 Drawing Sheets

CONNECTOR AND ASSEMBLING METHOD THEREFOR

BACKGROUND OF THE INVENTION

1. Field of the Invention

The invention relates to a connector and to an assembling method therefor.

2. Description of the Related Art

Japanese Unexamined Patent Publication No. H11-54203 discloses a connector assembly with first and second housings that can be connected together. The first housing has a bolt and the second housing has a nut. Threaded connection of the nut with the bolt pulls the housings together. Thus, a connector with a relatively large connection resistance, such as a multi-contact connector, can be connected.

The bolt of this assembly can be tightened even if the housings are inclined. Thus, male terminals in one housing abut the front surface of the mating housing without entering the female terminals. The connector does not detect that the two housings have reached a connection depth where the bolt can be tightened. Therefore there is a likelihood of deforming the male terminals and/or damaging the housings.

The invention was developed in view of the above problems, and an object thereof is to improve operability of the assembling procedure.

SUMMARY OF THE INVENTION

The invention relates to a connector with first and second housings that are connectable with each other. The housings can be connected completely by tightening at least one bolt after being fit to a specified depth and substantially centered with respect to each other. At least one resiliently deformable detection arm is provided on the first housing, and at least one receiving portion is provided on the second housing. The detection arm resiliently returns when the housings are fit to the specified depth and impacts the receiving portion. The impact of the detection arm with the receiving portion creates an audible and tactile indication that a connection depth has been reached where the bolt can be tightened. Thus, deformation of male terminals and damage to the housings caused by tightening the bolt can be avoided.

The detection arm preferably has an opening exposed to the outside, and the receiving portion is engaged with an opening edge of the opening. Thus, an engaged state of the detection arm and the receiving portion can be confirmed visually. This visual confirmation provides a further indication that a connection depth has been reached where the bolt can be tightened.

One of the connectors preferably is mounted to a member, such as a casing. At least one mounting projection preferably projects from the member and towards the one connector. The mounting projection is dimensioned to contact a bulge when bolt has been tightened sufficiently for the two connectors to be connected completely. Thus, the contact between the mounting projection and the bulge stops the tightening operation and prevents any further connection of the connectors.

A seal ring preferably is mounted in close contact over substantially the entire periphery between the two connectors, thereby contributing to stabilizing the postures of the connectors.

An intermediate connector may be provided between the first and second housings and may have at least one intermediate terminal. The terminals of the first and second connectors are connected electrically by the at least one intermediate terminal.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
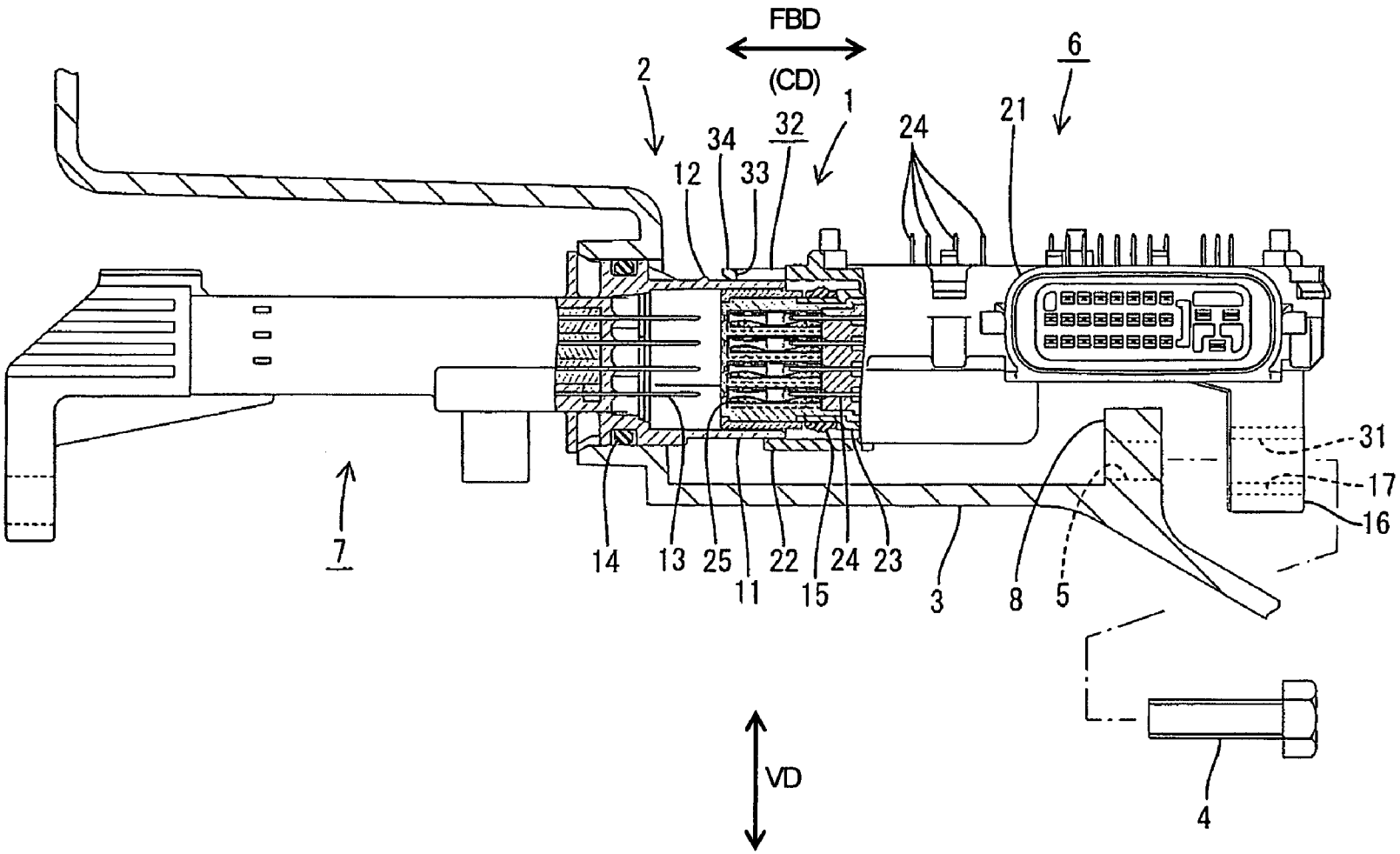
FIG. 1 is a side view partly in section showing a connector before reaching a specified connection depth.
Figure 2:
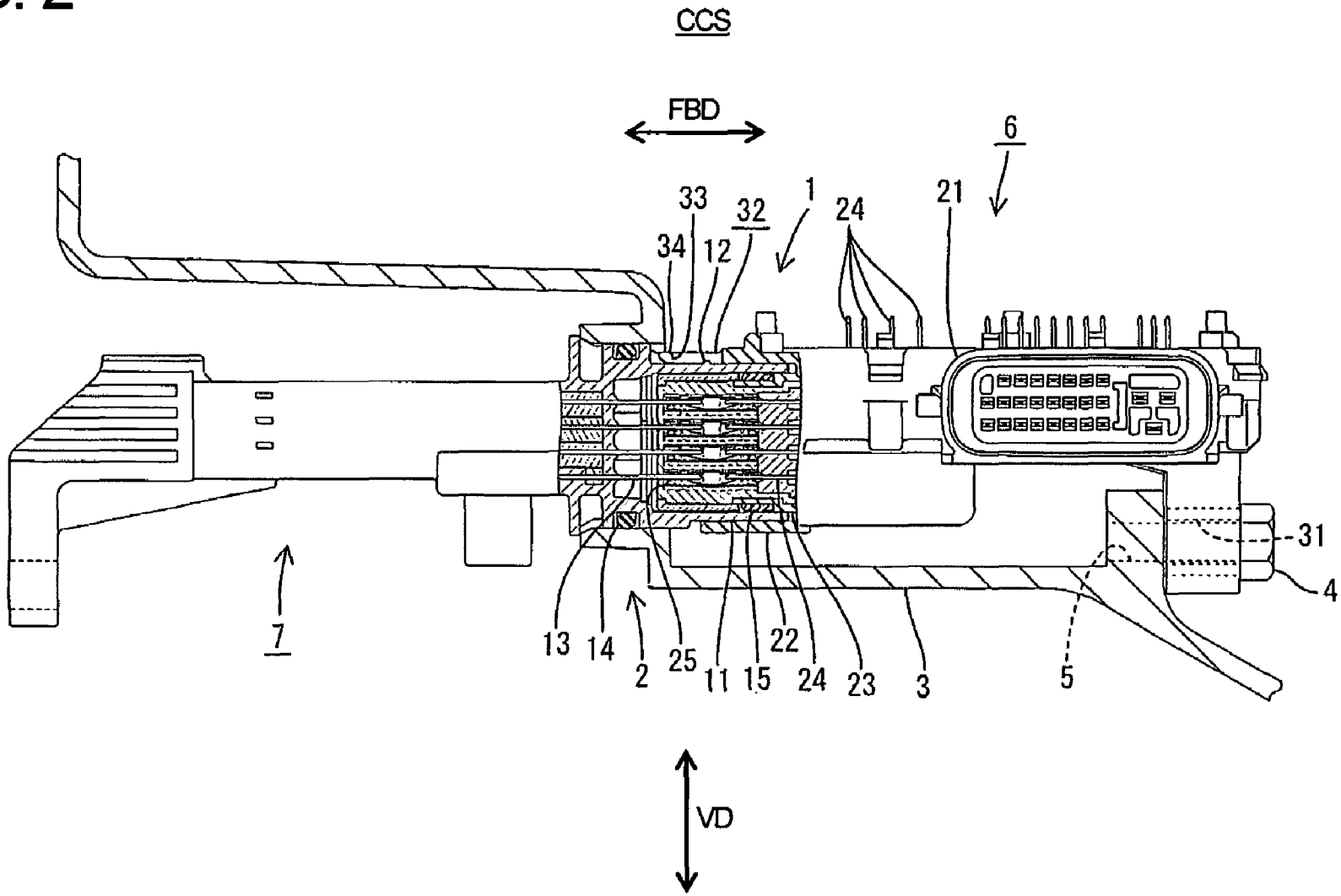
FIG. 2 is a side view partly in section showing a state where two connectors are connected completely.

An ECU (electronic control unit) connector according to the invention is identified by the numeral 1 and is connectable to a tower connector 2, as shown in FIGS. 1 to 6. The ECU connector 1 is built integrally on an ECU casing 6 to be installed in an automotive vehicle and the tower connector 2 is to be mounted in a transmission casing 3. The connectors 1, 2 are bolt-tightened connectors that are connected completely by tightening at least one bolt 4. Ends of the connectors 1, 2 that are to be connected are referred to as the fronts. The transverse direction in FIG. 1 is the forward and backward direction FBD and reference is made to FIG. 1 concerning the vertical direction VD, which is substantially normal to the forward and backward directions FBD.

The tower connector 2 has a resin housing near the front end of a tower 7. The tower connector 2 is long in forward and backward directions FBD, as shown in FIG. 1 and has a receptacle 11 with an open front end. Male terminals 13 project forward from the back in the receptacle 11. The tower connector 2 is mounted to the transmission casing 3 via a rubber seal 14 near the base end of the receptacle 11. The receptacle 11 and the male terminals 13 are exposed to the outside of the transmission casing 3. A mounting projection 8 projects towards the ECU connector 1 at a specified position on the outer surface of the transmission casing 3. At least one tightening hole 5 penetrates the mounting projection 8 in forward and backward directions FBD and is used to tighten the bolt 4. An internal thread is formed in the inner circumferential surface of the tightening hole 5 and spirally engages the bolt 4.

Figure 3:
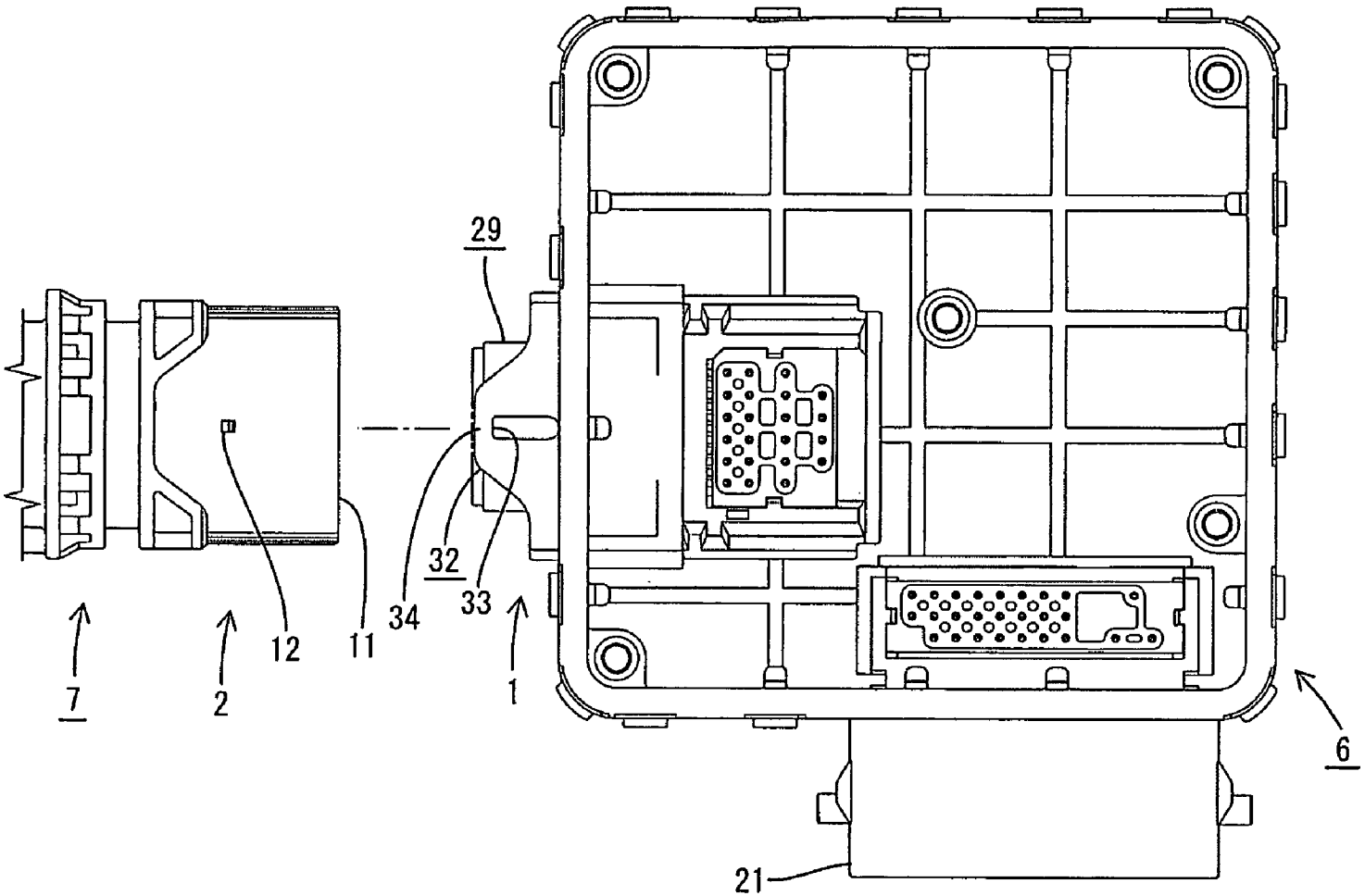
FIG. 3 is a plan view showing a state before the connection of the two connectors is started.
Figure 4:
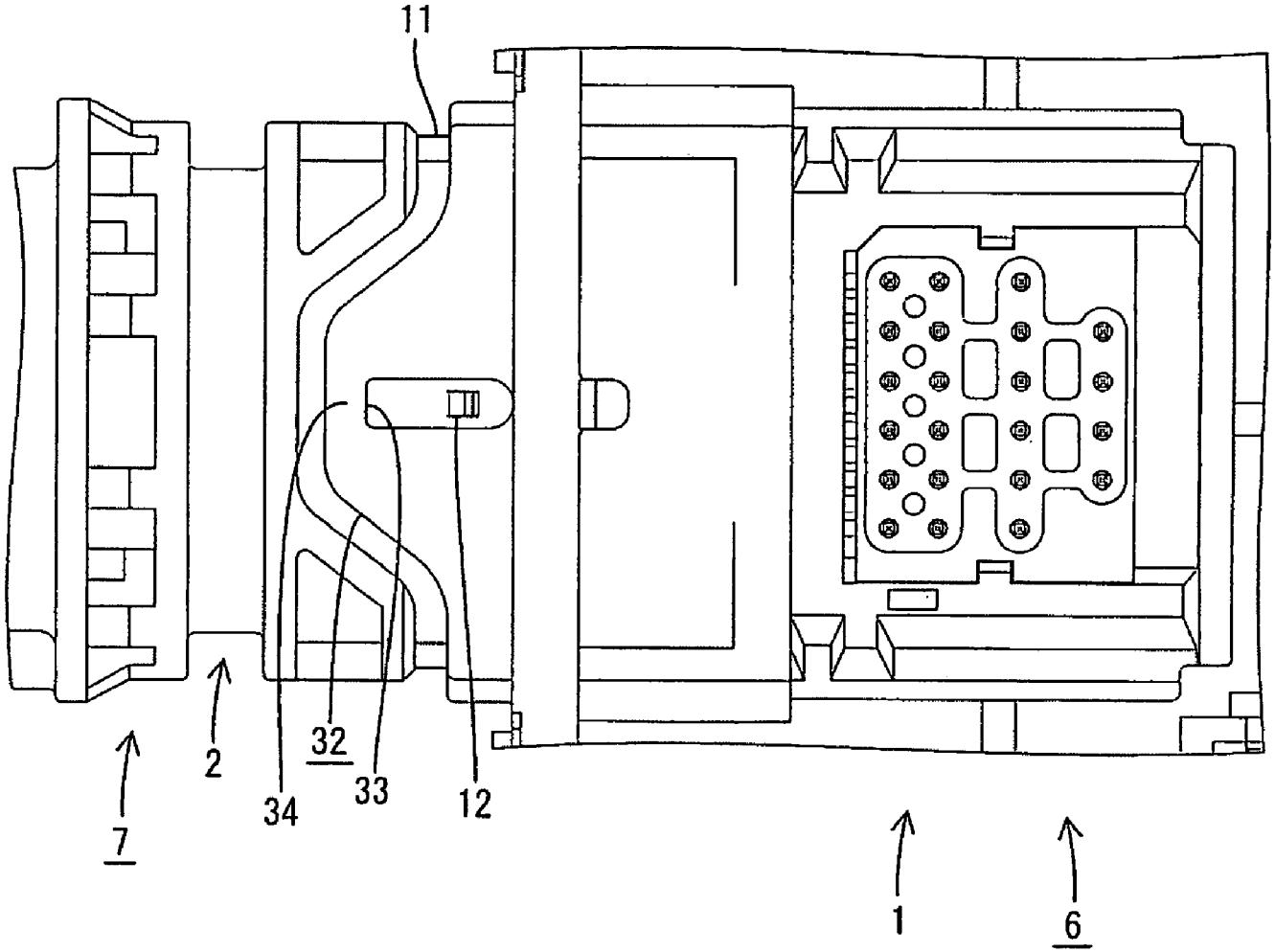
FIG. 4 is an enlarged plan view showing an essential portion of the completely connected connectors.
Figure 6:
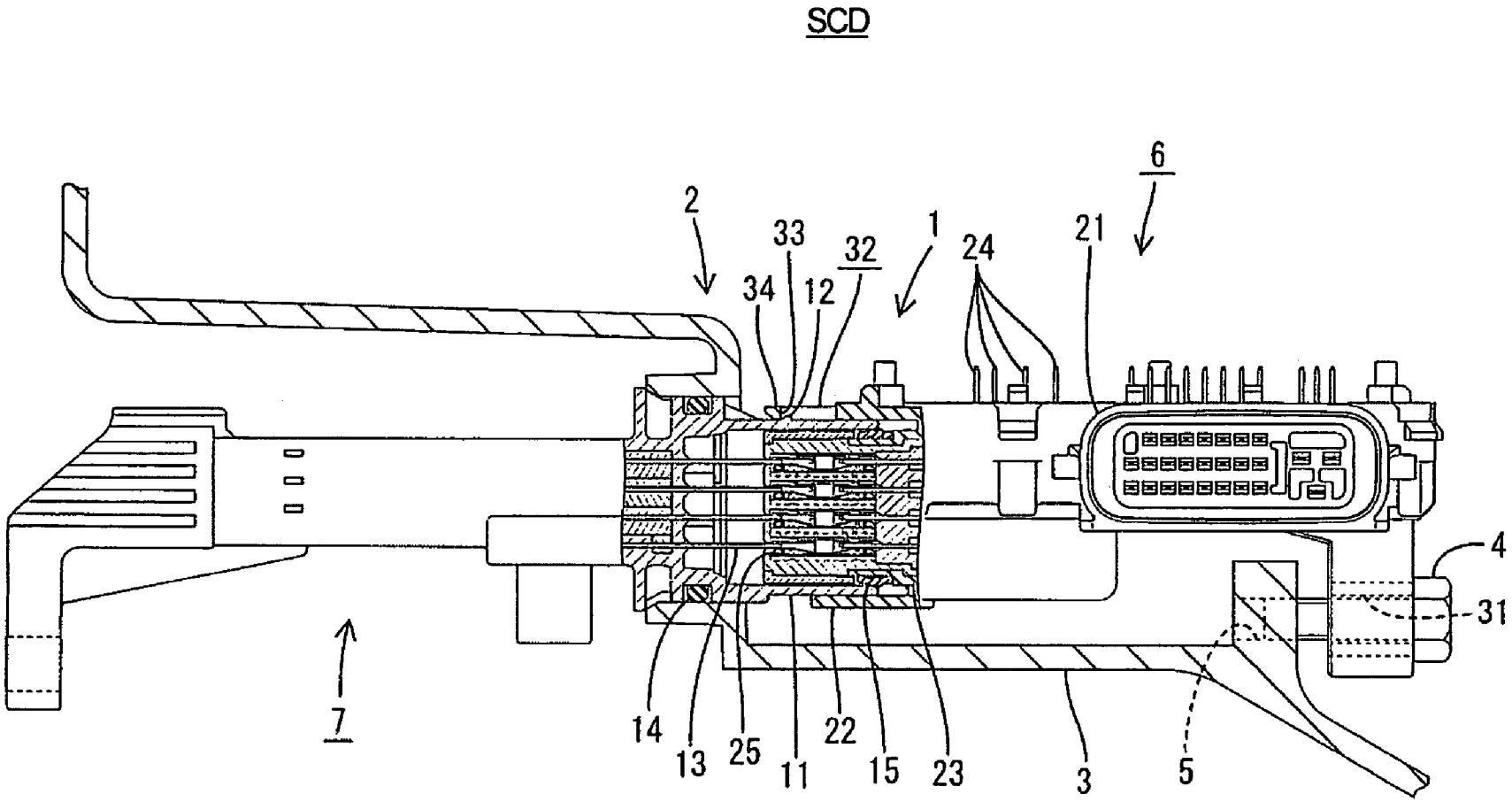
FIG. 6 is a plan view partly in section showing the two connectors at a specified connection depth.

The ECU connector 1 has a housing made e.g. of a resin that projects forward at the front end of the ECU casing 6 in the form of a substantially rectangular shallow saucer as shown in FIG. 3. A connector 21 for connection with another device (not shown) projects out from an edge of the ECU casing 6 adjacent the edge where the ECU connector 1 is arranged. On the other hand, a bulge 16 extends towards the transmission casing 3 at the bottom surface of the rear end of the ECU casing 6, as shown in FIG. 1. An insertion hole 31 penetrates the bulge 16 in forward and backward directions FBD, and loosely receives the bolt 4. A metal sleeve 17 is mounted circumferentially on the inner circumferential surface of the insertion hole 31. The front end surface of the bulge 16 contacts the rear end surface of the mounting projection 8 when the two connectors 1, 2 are connected completely by tightening the bolt 4. Thus, the tightening operation is stopped to prevent any further connection of the connectors 1, 2. FIG. 6 shows a sectional view when the two connectors 1, 2 are at a specified connection depth SCD. A distance between the front end surface of the bulge 16 and the rear end surface of the mounting projection 8 substantially corresponds to a connection stroke from the state of FIG. 6 to a substantially completely connected state CCS (state of FIG. 2). At this time, the insertion hole 31 is substantially coaxial with the tightening hole 5. Thus, the bolt 4 can be turned into the tightening hole 5 through the insertion hole 31.

Figure 5:
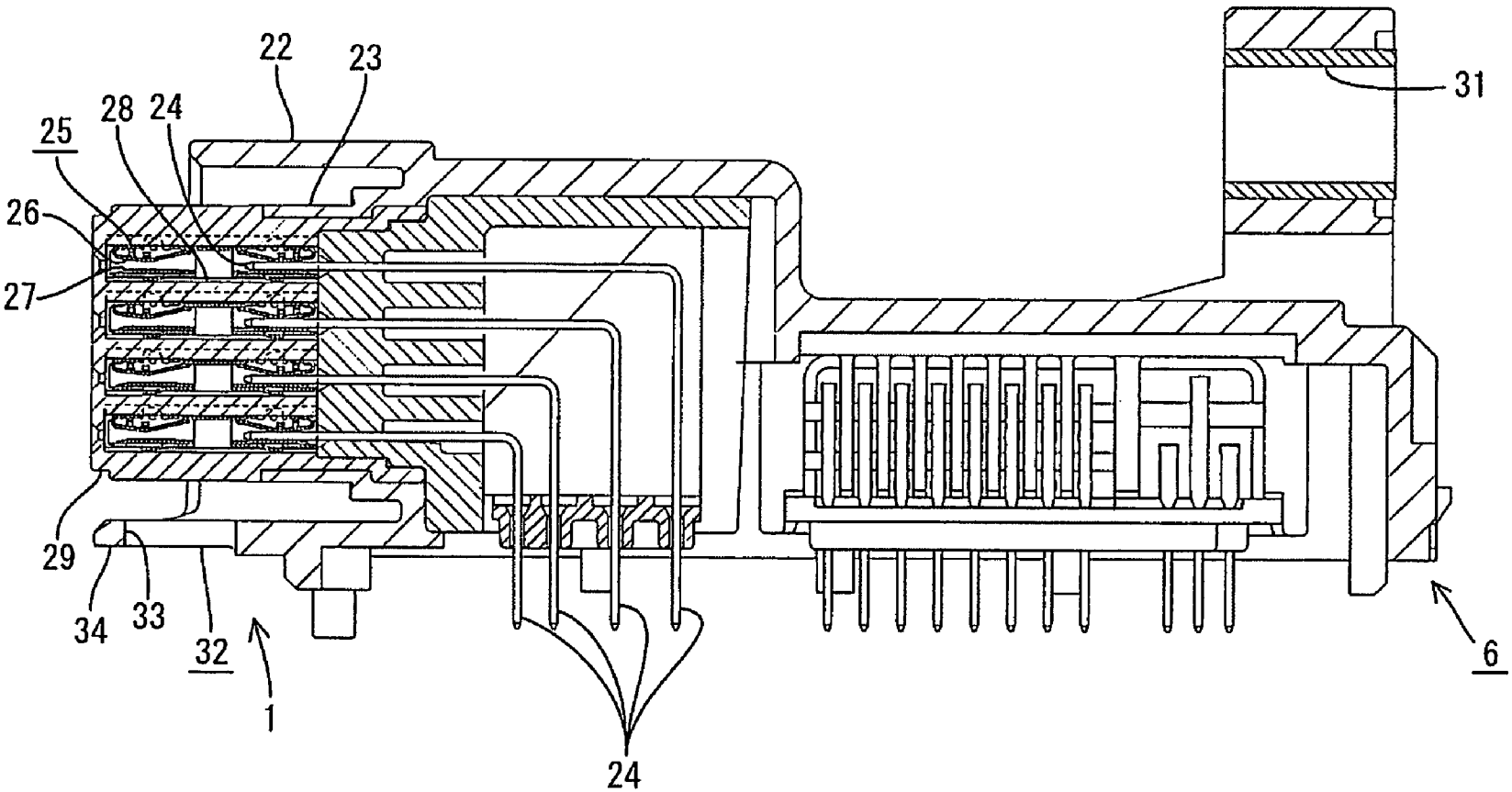
FIG. 5 is a section of one of the connectors.

As shown in FIG. 5, the ECU connector 1 includes a forwardly projecting outer tube 22 and a forwardly projecting inner tube 23 inside the outer tube 22. The receptacle 11 of the tower-side connector 2 is insertable into a clearance between the outer tube 22 and the inner tube 23 via a seal ring 15. Substantially L-shaped ECU male terminals 24 are pressed or insert molded into the ECU connector 1 so that front ends of the ECU male terminals 24 project forward from the back side of the inner tube 23. The rear ends of the ECU male terminals 24 are bent up substantially normal to the front ends and project up from the upper surface of the ECU connector 1.

As shown in FIG. 5, an intermediate connector 29 is fit into the inner tube 23 and has cavities 28 penetrating in forward and backward directions FBD. Intermediate female terminals 25 are arranged in the cavities 28. The female terminals 25 can receive the ECU male terminals 24 from behind and the tower-side male terminals 13 from the front to connect the ECU male terminals 24 and the tower-side male terminals 13 electrically. Resilient contact pieces 26 are formed near the opposite front and rear ends of the inner bottom surface of each female terminal 25 by folding portions of the female terminal 25 near the front and rear edges. The resilient contact pieces 26 are resiliently deformable substantially along the vertical direction VD for the connection with the tower male terminal 13 and the ECU male terminal 24. Contact projections 27 project in at positions on the ceiling surface of each female terminal 25 substantially facing the resilient contact pieces 26, so that the tower male terminal 13 and the ECU male terminal 24 can be squeezed between the resilient contact pieces 26 and the contact projections 27 to establish electrical contacts. The leading ends of the tower male terminals 13 are accommodated in the female terminals 25, as shown in FIG. 6, when the two connectors 1, 2 are at the specified connection depth SCD. At this time, the two connectors 1, 2 are fit together in stable connection postures by reaching an area set to reduce a clearance between the two connectors 1, 2. In addition, a seal ring 15 is mounted in close contact over the entire periphery between the two connectors 1, 2, for further stabilizing the postures of the connectors 1, 2. As a result, the center axes of the two connectors 1, 2 are aligned properly with each other at the specified connection depth SCD and the center axes of the tower male terminals and the female terminals 25 are aligned. Therefore, the connectors 1, 2 do not shake.

As shown in FIG. 3, a detection arm 32 bulges out forward in a substantially widthwise middle part of the front edge of the upper surface of the outer tube 22. A leading end 34 of the detection arm 32 is resiliently displaceable in a direction substantially normal to a connection direction CD of the two connectors 1, 2 and substantially normal to the forward and backward directions FBD. A substantially rectangular opening 33 is formed substantially in the widthwise center of the detection arm 32 and is long in forward and backward directions FBD. On the other hand, a receiving portion 12 projects at a position slightly behind the center on the respective upper surface of the receptacle 11 of the tower connector 22. The leading end 34 of the detection arm 32 moves over the receiving portion 12 as the two connectors 1, 2 reach the specified connection depth SCD. The leading end 34 of the detection arm 32 then resiliently returns thereby hitting or impacting the upper surface of the receptacle 11 to provide an audible and tactile indication that the specified connection depth SCD has been reached. Simultaneously, the receiving portion 12 engages an opening edge of the opening 33 to hold the two connectors 1, 2 at the specified connection depth SCD. The bolt 4 is advanced through the insertion hole 31 and tightened into the tightening hole 5 so that the connectors 1, 2 progress smoothly towards the completely connected state CCS. Thus, the two connectors 1, 2 are aligned and positioned at the specified connection depth SCD.

Further, as shown in FIG. 6, one of the two locking surfaces is inclined moderately when the receiving portion 12 and the opening edge of the opening 33 are engaged with each other with the two connectors 1, 2 at the specified connection depth SCD, i.e. constituting a semi-locking construction. Thus, the leading-end portion 34 of the detection arm 32 moves over the receiving portion 12 to cancel the locked state (state in FIG. 1) so that the two connectors 1, 2 can be separated.

The ECU connector 1 is inserted manually into the receptacle 11 of the tower connector 2. As a result, the leading ends of the tower male terminals 13 are accommodated into the female terminals 25. Additionally, the leading end 34 of the detection arm 32 moves over the receiving portion 12 of the receptacle 11 and resiliently returns to hit the upper surface of the receptacle 11. Thus, there is an audible and tactile indication that the specified connection depth SCD has been reached. The receiving portion 12 engages the opening edge of the opening 33 of the detection arm 32 at this time to hold the ECU connector 1 at the specified connection depth SCD and provides a visual confirmation that the specified connection depth SCD has been reached. At the specified connection depth SCD, the bolt 4 may be turned and tightened into the tightening hole 5 through the insertion hole 31. As a result, the connected state progresses to the completely connected state CCS (state in FIG. 2). Further, at the specified connection depth SCD, the two connectors 1, 2 can be separated from each other by exerting specified forces in the separating directions to cancel the locked state. Thus an easy exchange and a quick repair can be completed for maintenance of the ECU.

As described above, the two connectors 1, 2 are fit manually to the specified connection depth SCD and substantially centered with respect to each other before tightening the bolt. If the two connectors 1, 2 are not centered, an operator feels a resistance force larger than usual during the period until the specified connection depth SCD is reached. Thus, the housings are connected while making fine adjustments. Accordingly, there is no likelihood of exerting an excessive force to the tower-side male terminals 13 and the like. It can be detected that the specified connection depth SCD has been reached and the two connectors 1, 2 can be held at the specified connection depth SCD when the detection arm 32 resiliently engages the receiving portion 12 to impact the facing surface of the receptacle 11. By starting bolt tightening thereafter, it is possible to avoid problems such as deformations of the leading ends of the tower male terminals 13 and damage to the two connectors 1, 2.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Detection is made when the detection arm hits the outer surface of the housing of the tower-side connector in the foregoing embodiment. However, other modes may be adopted provided that the detection can be made. For example, a construction to hit the outer surface of the connector housing of the ECU connector may be adopted. A hitting method is adopted because it is, in some cases, difficult to see during the operation by visual confirmation, and it is, in some cases, difficult to distinguish a sound from an ambient noise. However, a sound generating hitting may be adopted to the circumstances.

The detection arm is on the ECU connector and the receiving portion is on the tower connector in the foregoing embodiment. However, the detection arm may be on the tower connector and the receiving portion may be on the ECU connector.

Although the bolt is tightened in cooperation with the tightening hole formed in the transmission casing in the foregoing embodiment, another mode may be adopted provided that a tightening operation is possible. For example, the connectors may be directly tightened by a bolt.

What is claimed is:

1. A connector, comprising:

first and second housings that are connectable with each other, the first and second housings being mounted respectively in first and second casings, the first casing being formed with a mounting projection having a threaded hole, the second casing being formed with a bulge having an insertion hole substantially registered with the threaded hole, the bulge contacting the mounting projection when the housings reach a completely connected state for preventing further connection, the housings being completely connected by tightening a bolt inserted through the insertion hole and into the threaded hole after the housings are fit to a specified depth and substantially centered with respect to each other;

at least one resiliently deformable detection arm on the first housing; and at least one receiving portion on the second housing, wherein the detection arm is disposed for engaging the receiving portion while making a resilient returning movement when the housings are fit to the specified depth, and a surface substantially facing the detection arm being disposed to be hit by the detection arm upon the resilient return of the detection arm.

2. The connector of claim 1, wherein the detection arm is formed with an opening exposed to the outside, and the receiving portion being engaged with an opening edge of the opening so that an engaged state of the detection arm and the receiving portion can be visually confirmed.

3. The connector of claim 1, wherein the first housing is mounted to a member having at least one mounting projection projecting towards the first housing at a specified position on the member.

4. The connector of claim 1, wherein a seal ring is mounted in close contact over substantially an entire periphery between the two housings for stabilizing postures of the housings.

5. The connector of claim 1, wherein an intermediate connector having intermediate terminals is provided between the first and second housings and terminals in the first and second housings are connected electrically via the intermediate terminals.

6. A connector, comprising:

a first housing mounted in a first casing and having first terminals mounted therein, the first casing being formed with a mounting projection with a threaded hole therein, a resiliently deformable detection arm projecting from the first housing;

an intermediate connector having intermediate terminals mounted therein, the intermediate connector being connected with the first housing so that the first terminals connect electrically with the intermediate terminals; and a second housing mounted in a second casing and having second terminals therein, the second housing being connectable with the first housing so that the second terminals connect electrically with the intermediate terminals, the second casing being formed with a bulge disposed for contacting the mounting projection when the housings reach a completely connected state for preventing further connection, the bulge being formed with an insertion hole substantially registered with the threaded hole so that a bolt can be inserted through the insertion hole and threaded into the threaded hole for urging the housings into the completely connected state, the second housing being formed with an outer surface, at least one receiving portion projecting from the outer surface and being disposed for engaging and deflecting the detection arm during connection of the first and second housings, the outer surface being disposed to be hit by the detection arm upon the resilient return of the detection arm when the housings are fit to a specified depth.

* * * * *